United States Patent [19]

McCormick

[11] Patent Number: 4,832,635

[45] Date of Patent: May 23, 1989

[54] NOSE CONSTRUCTION FOR THE GEAR CASE OF A MARINE DRIVE

[75] Inventor: Daniel F. McCormick, Oshkosh, Wis.

[73] Assignee: Brunswick Corporation, Skokie, Ill.

[21] Appl. No.: 160,631

[22] Filed: Feb. 26, 1988

[51] Int. Cl.[4] ..... B63H 21/26; B63H 21/38

[52] U.S. Cl. ..... 440/78; 440/88

[58] Field of Search ..... 440/88, 78, 76, 83, 440/75, 900

[56] References Cited

U.S. PATENT DOCUMENTS

| | | | |
|---|---|---|---|
| 2,153,626 | 4/1939 | Kissel | 440/88 |
| 2,656,812 | 10/1953 | Kiekhaefer | 416/73 R |
| 3,487,803 | 1/1970 | Alexander, Jr. | 440/75 |

*Primary Examiner*—Sherman D. Basinger

*Attorney, Agent, or Firm*—Andrus, Sceales, Starke & Sawall

[57] ABSTRACT

A marine drive unit (1) includes a lower propeller torpedo housing (9) of generally cylindrical configuration having a longitudinal centerline (19). A propeller shaft (17) is mounted in the housing for rotation on an axis (20) offset from the centerline. The shaft is journalled in a forward bearing assembly (18) which is held in place by a support (25) adjustably mounted to the housing and on the offset axis. A nose (30) is removably secured to the forward housing end by a mounting bolt (40) which extends into the support on the offset axis. A single multi-purpose opening or port (34) in the forward end of the nose communicates to an interior entry passage (35) in the nose. The entry passage in turn merges into a pair of passage branches (36,37). One branch (36) is disposed on the offset propeller shaft axis and receives the mounting bolt. The other branch (37) is positioned to communicate with the cooling water passages (21–23) in the lower unit, and which lead to the marine drive engine (4). A torque retention and sealing member (42) is disposed between the support and the nose. Furthermore, a torque retention and sealing member (44) is disposed between the bolt head and the inner end of its passage branch.

6 Claims, 2 Drawing Sheets

NOSE CONSTRUCTION FOR THE GEAR CASE OF A MARINE DRIVE

BACKGROUND AND SUMMARY OF THE INVENTION

This invention relates to a nose cone construction for the gear case of a marine drive.

Marine drives normally include an outboard positioned drive unit which includes a lower gear case formed at its lower end in a manner to provide a generally horizontal torpedo housing. In some instances, water intake openings are provided in the upper portion of the gear case above the propeller drive shaft housing. In other instances, as shown for example in U.S. Pat. Nos. 2,656,812 and 3,487,803, the bore of the propeller shaft housing is closed at its forward end by a conical nose member which includes a plurality of water inlet openings on its periphery. In U.S. Pat. No. 3,487,803 for example, a conical nose head has a bolt which extends into the propeller shaft bore and which is suitably secured at its inner end to a seal support member. The construction is such that the elements are all disposed on a common axis.

In some instances it may be desirable to offset the axis or centerline of the torpedo housing from the axis of the propeller shaft itself. In so doing, the securing bolt also needs to be offset from the centerline of the torpedo. In addition, it is desirable to dispose the water inlet in the most advantageous position.

It is an object of the invention to provide the desired offset, and to improve the positioning of the water inlet, all with a minimum of drag. It is a further object to accomplish the desired results with a maximum of torque retention of the parts involved.

In accordance with the various aspects of the invention, a marine drive unit includes a lower propeller torpedo housing of generally cylindrical configuration having a longitudinal centerline. A propeller shaft is mounted in the housing for rotation on an axis offset from the centerline. The shaft is journalled in a forward bearing assembly which is held in place by a support adjustably mounted to the housing and on the offset axis. A nose is removably secured to the forward housing end by a mounting bolt which extends into the support on the offset axis. A single multi-purpose opening or port in the forward end of the nose communicates to an interior entry passage in the nose. The entry passage in turn merges into a pair of passage branches. One branch is disposed on the offset propeller shaft axis and receives the mounting bolt. The other branch is positioned to communicate with the cooling water passages in the lower unit, and which lead to the marine drive engine. A torque retention and sealing member is disposed between the support and the nose. Furthermore, a torque retention and sealing member is disposed between the bolt head and the inner end of its passage branch.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
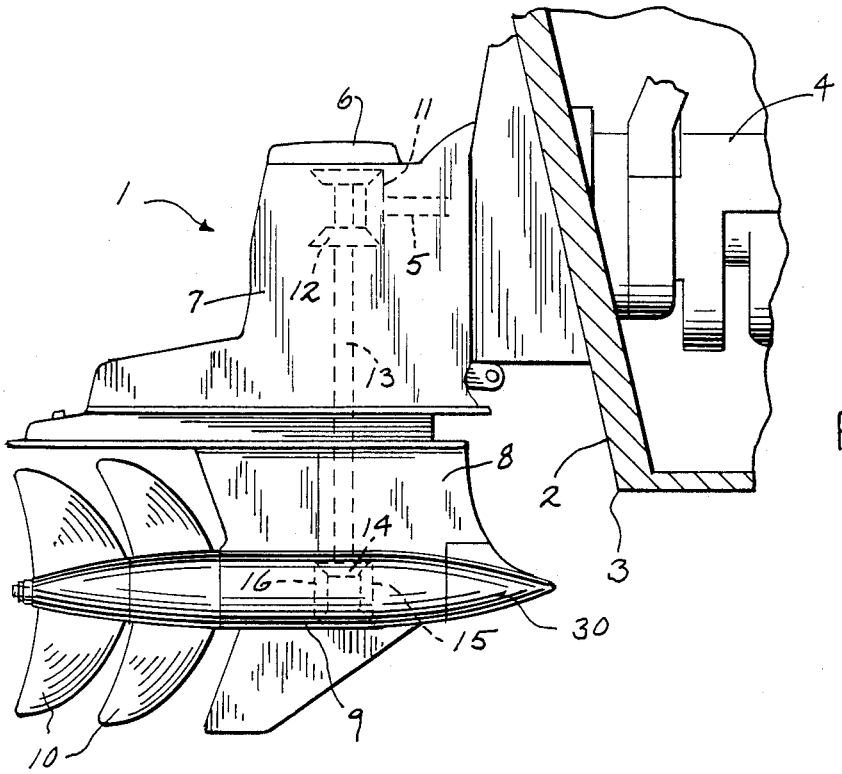
FIG. 1 is a generally schematic perspective view of a boat mounted marine drive incorporating the various aspects of the invention.

As shown in the drawings, the various aspects of the invention are contemplated for use in a marine drive, which in the present embodiment comprises a stern drive unit 1 adapted to be suitably mounted to the transom 2 of a boat 3. An internal combustion engine 4 is disposed within the boat and includes an output with a shaft 5 which extends through transom 2 to unit 1, in the usual manner.

Stern drive unit 1 generally includes a stern drive housing 6 forming an upper gear case 7, a lower gear case 8 suitably mounted to gear case 7, and a generally horizontally extending torpedo housing 9 disposed at the bottom of gear case 8. In the present embodiment, a pair of propellers 10 are mounted for contra-rotation aft of housing 9. For driving the propellers, a pinion 11 is disposed on the outer end of shaft 5 and meshes with a gear 12 mounted to the upper end of a vertical drive shaft 13 within upper gear case 7. Drive shaft 13 extends downwardly and through lower gear case 8, and has a pinion 14 on its lower end which meshes with a pair of gears 15 and 16. These gears form part of a drive which rotates a central propeller shaft 17 for one propeller, and a concentric propeller shaft (not shown) for the other propeller, in the usual well-known manner.

The forward end of propeller shaft 17 is journalled in a suitable bearing assembly 18 of any well-known type which is mounted within torpedo housing 9.

Torpedo housing 9 is generally cylindrical, and in the present embodiment is shown as torpedo-shaped.

The arrangement is such that propeller shaft 17 and its mate define a first or drive axis 19, and torpedo housing 9 has a longitudinal centerline defining a second axis 20 which is offset upwardly and at a slight angle to axis 20.

For cooling purposes, housing 6 is provided with a vertically extending water chamber 21. The lower end of chamber 21 communicates through an L-shaped inlet passage 22 in lower gear case 8 and which has a forwardly facing entrance portion 23. The upper end of chamber 21 communicates through a port 24 which in turn connects to engine 4 in the usual manner for cooling the latter.

Figure 3:
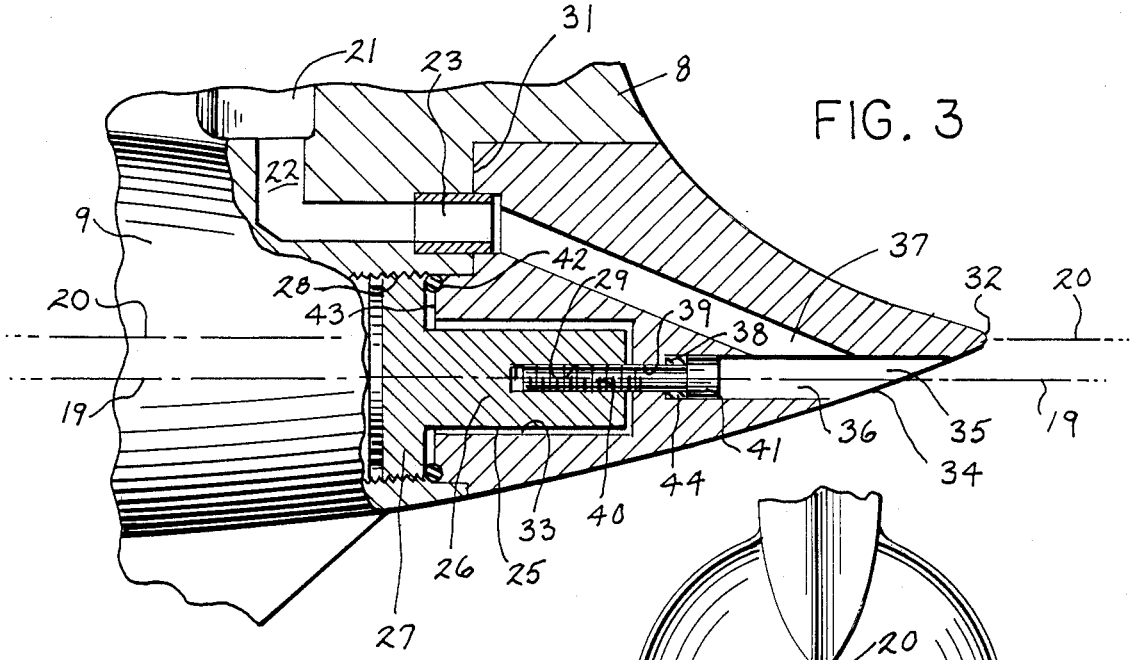
FIG. 3 is fragmentary generally sectional view of the mounted nose.
Figure 4:
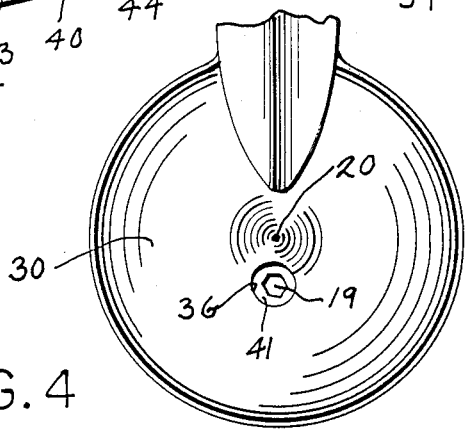
FIG. 4 is a front end elevation of the nose.
Figure 2:
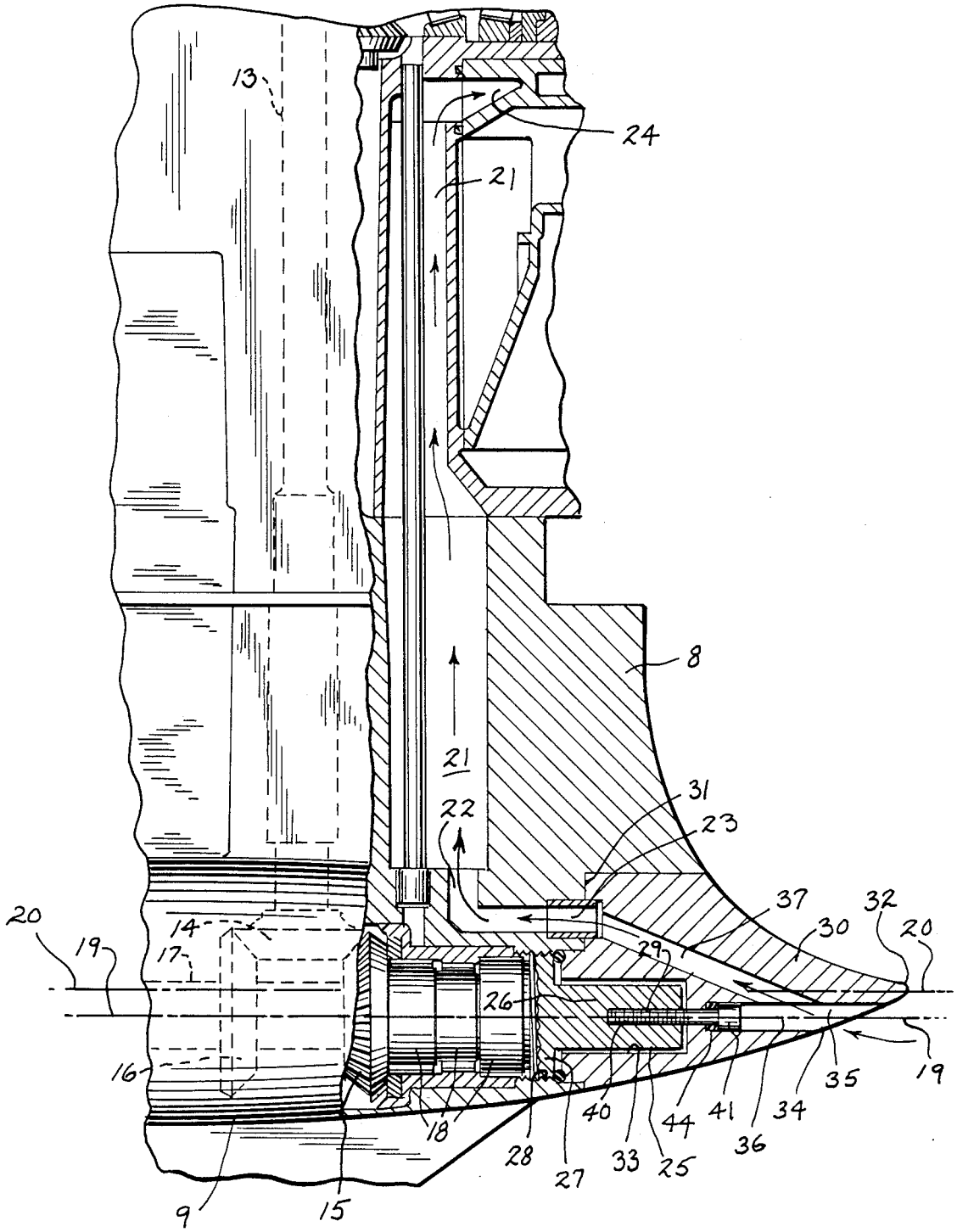
FIG. 2 is an enlarged vertical elevation, with parts broken away and in section, of the forward portion of the drive.

As best seen in FIGS. 2 & 3, retainer means are provided to secure bearing assembly 18 in place within housing 9. For this purpose, a plug-like support member or retainer 25 having a forwardly disposed central body portion 26 and a rearwardly disposed annular flange 27 is removably and threadably mounted, as at 28, to the forward open ended portion of propeller housing 9, and on axis 19. Flange 27 is adapted to adjustably hold assembly 18 in place. Retainer body portion 26 extends outwardly from housing 9 and is provided with a threaded central bore 29, also on axis 19, for purposes to be described.

In accordance with certain aspects of the invention, removable means are provided to close the open forward end of torpedo housing 9 and to also provide for entry of cooling water into the drive unit. For this purpose, a closure in the form of a generally conical nose 30 is constructed and adapted to be mounted to housing 9 and so that it closingly abuts a forwardly facing annular shoulder 31 on the housing. The body of nose 30 is contoured so that its terminus 32 lies on housing axis 20.

Furthermore, the body of nose 30 incorporates means to provide access to a securement device as well as means for water ingress into the system. For this purpose, a longitudinal recess 33 is disposed in the rearward face of nose 30 for receiving the plug-like retainer body 26 therein. A single inlet or entrance port 34 is disposed in the curved forward face of the body of nose 30 and longitudinally in line with the centerline of recess 33. Port 34 opens inwardly to a longitudinal interior entry passage 35, which is coaxial with recess 33. Passage 35 merges inwardly into a pair of passage branches 36 and 37. Thus branches 36 and 37 have a common entrance.

Branch 36 forms a continuation of passage 35 and bottoms out inwardly of recess 33, as at 38. A central opening 39 of reduced diameter joins branch 36 and recess 33. Port 34, entry passage 35, branch 36 and opening 39 are coaxially disposed.

Branch 37 diverges upwardly from passage 35-branch 36 and terminates in a rearwardly facing portion of nose 30.

Nose 30 is assembled to torpedo housing 9 by means of a threaded bolt 40 having a head 41. Bolt 40 is inserted through the longitudinal passage which includes branch 36, and hence through opening 39 into recess 33 and is rotateably threaded into bore 29 by any suitable tool. As this is done, retainer 25 is pulled forwardly and tightened against an annular sealing O-ring 42, which is compressed against a rearward face 43 of nose 30. O-ring 42 also serves as a torque retention means to retard undesirable rotation of threaded retainer 25 (and thus loss of adjustment) during subsequent use of the device.

In addition, a compressible sleeve 44 of Nylon or the like is disposed in the inner end of branch 36, and is confined between the bottom 38 of the branch and bolt head 41. As bolt 40 is tightened, sleeve 44 is compressed and thus serves as a torque retention means to retard undesirable rotational loosening of the bolt during subsequent use of the device and also to seal the end of branch 36.

When nose 30 is fully assembled to torpedo housing 9, the resultant configuration is such that branch 36, bolt 40 and retainer 25 are all on a common axis, namely propeller axis 19, and are thus laterally offset from the centerline axis 20 of housing 9.

Likewise, upon assembly, the inner end of diverging passage branch 37 registers with the entrance 23 to water passage 22 and water chamber 21. Communication is thus created for cooling water flow between port 34 and engine 4.

The result is that the single port 34 and entry passage 35 provide a dual function. They permit insertion of the mounting bolt 40, and also serve as the engine cooling water inlet for the drive. By providing a dual purpose common-entrance passageway system in the nose, undesirable drag forces in the water are reduced to a minimum in that portion of lower gear casing 8.

Various modes of carrying out the invention are contemplated as being within the scope of the following claims, which particularly point out and distinctly claim the subject matter regarded as the invention.

I claim:

1. In a marine drive, the combination comprising:

(a) a gear case (8) containing drive means (11–13) and cooling water passage means (21–23) for connection to an engine, (b) a generally cylindrical fore-to-aft extending torpedo housing (9) disposed adjacent the lower end of said gear case, (c) said torpedo housing containing propeller shaft means (17) and having an open forward end, (d) a support member (25) disposed at the forward end of said housing, (e) a nose (30) for closing said open forward end of said housing, (f) a pair of passages (36,37) disposed within said nose, (g) the first of said passages (36) containing a removable bolt (40) threadably secured to said support member to tightenably mount said nose to said housing, (h) and the second of said passages (37) registering with said cooling water passage means, (i) said bolt including a head (41) disposed at the inner end portion of said first passage, (j) and torque retention and sealing means (44) confined between said bolt head and the inner end portion of said first passage and compressible therebetween when said bolt mounts said nose to said housing to retard subsequent rotation of said bolt and to provide a seal at said bolt head in the said first of said passages.

2. In a marine drive, the combination comprising:

(a) a gear case (8) containing drive means (11–13) and cooling water passage means (21–23) for connection to an engine, (b) a generally cylindrical fore-to-aft extending torpedo housing (9) disposed adjacent the lower end of said gear case, (c) said torpedo housing containing propeller shaft means (17) and having an open forward end, (d) a support member (25) disposed at the forward end of said housing, (e) a nose (30) for closing said open forward end of said housing, (f) a pair of passages (36,37) disposed within said nose, (g) the first of said passages (36) containing a removable bolt (40) threadably secured to said support member to tightenably mount said nose to said housing, (h) the second of said passages (37) registering with said cooling water passage means, (i) said first and second passages connecting to a common entrance port (34,35) disposed at the forward end of said nose, (j) said support member (25) being adjustably rotatably mounted to said torpedo housing (9), (k) and torque retention means (42) confined between said support member and said nose (30) and compressible by the latter when said bolt (40) tightenably mounts said nose to said housing to retard subsequent rotation of said support member.

3. In a marine drive, the combination comprising:

(a) a gear case (8) containing drive means (11–13) and cooling water passage means (21–23) for connection to an engine, (b) a generally cylindrical fore-to-aft extending torpedo housing (9) disposed adjacent the lower end of said gear case, (c) said torpedo housing containing propeller shaft means (17) and having an open forward end,
(d) a support member (25) disposed at the forward end of said housing,
(e) a nose (30) for closing said open forward end of said housing,
(f) a pair of passages (36,37) disposed within said nose,
(g) the first of said passages (36) containing a removable bolt (40) threadably secured to said support member to tightenably mount said nose to said housing,
(h) the second of said passages (37) registering with said cooling water passage means,
(i) said first and second passages connecting to a common entrance port (34,35) disposed at the forward end of said nose,
(j) said bolt (40) including a head (41) disposed at the inner end portion of said first passage (36),
(k) and torque retention and sealing means (44) confined between said bolt head and the inner end portion of said first passage and compressible therebetween when said bolt mounts said nose to said housing to retard subsequent rotation of said bolt and to provide a seal at said bolt head in said first passage.

4. In a marine drive, the combination comprising:
(a) a gear case (8) containing drive means (11–13) and cooling water passage means (21–23) for connection to an engine,
(b) a generally cylindrical fore-to-aft extending torpedo housing (9) disposed adjacent the lower end of said gear case,
(c) said torpedo housing containing propeller shaft means (17) and having an open forward end,
(d) a support member (25) disposed at the forward end of said housing,
(e) a nose (30) for closing said open forward end of said housing,
(f) a pair of passages (36,37) disposed within said nose,
(g) the first of said passages (36) containing a removable bolt (40) threadably secured to said support member to tightenably mount said nose to said housing,
(h) the second of said passages (37) registering with said cooling water passage means,
(i) said first and second passages connecting to a common entrance port (34,35) disposed at the forward end of said nose,
(j) said support member (25) being adjustably rotatably mounted to said torpedo housing (9),
(k) said bolt (40) including a head (41) disposed at the inner end portion of said first passage (36),
(l) first torque retention and sealing means (42) confined between said support member and said nose (30) and compressible by the latter when said bolt (40) tightenably mounts said nose to said housing to retard subsequent rotation of said support member,
(m) and second torque retention and sealing means (44) confined between said bolt head and the inner end portion of said first passage and compressible therebetween when said bolt mounts said nose to said housing to retard subsequent rotation of said bolt.

5. The combination of claim 3 or 4:
(a) in which said propeller shaft means (17) and said support member (25) define a first axis (19),
(b) and in which said torpedo housing (9) has a centerline defining a second axis (20) disposed generally parallel to said first axis,
(c) said second axis being laterally offset from said first axis.

6. The combination of claim 5 in which said first passage (36) is disposed coaxial with said first axis (19).

* * * * *